US005718642A

United States Patent [19]

Cushing

[11] Patent Number: 5,718,642

[45] Date of Patent: Feb. 17, 1998

[54] GOLF CLUB SWING TRAINING DEVICE

[76] Inventor: John Joseph Cushing, 16972 Wabash Ave., Yorba Linda, Calif. 92686

[21] Appl. No.: 529,660

[22] Filed: Nov. 3, 1995

[51] Int. Cl.[6] ..... A63B 69/36

[52] U.S. Cl. ..... 473/235; 273/DIG. 30; 473/391; 473/280

[58] Field of Search ..... 273/186.5, DIG. 30; 473/235, 280, 391

[56] References Cited

U.S. PATENT DOCUMENTS

| | | | |
|---|---|---|---|
| 3,401,941 | 9/1968 | Hesidence | 273/186.5 |
| 3,870,316 | 3/1975 | DeBrorke | 273/186.5 |

*Primary Examiner*—George J. Marlo

[57] ABSTRACT

A golf club cover practice device, suitable for attaching to the head of a golf club, driver (11) that allows one to practice accuracy while swinging a golf club towards a golf ball size practice disk (22). In a preferred embodiment the device generally includes a flexible type material that has been formed into the shape of a golf club head (13) and has the ability to be opened, closed, and tightened. Attached to the device is a piece of hook and loop fastener that will lay over the club face when the cover is in position on the club. The opposite piece of hook and loop fastener will cover a golf ball size practice disk (22). The union of the two opposite pieces of hook and loop fastener, brought about by swinging the golf club toward the golf ball shaped practice disk (22) concludes with the disk adhering to the face of the golf club. Once accomplished one can see exactly where he is striking a golf ball with the face of his golf club. The practice disc (22) includes both a center hole (26) and a tee head shaped void (24) along its periphery so that said disc (22) may alternatively be fitted snugly over the top end of a standard golf tee, or one could fit a short length of tube shaped material into the center hole of a pair of discs to form a multi-surface teed construction.

1 Claim, 9 Drawing Sheets

GOLF CLUB SWING TRAINING DEVICE

BACKGROUND

1. Field of Invention

This invention relates to golf, specifically to a golf club accessory that allows one to practice accuracy while swinging at a golf ball size disk.

2. Description of Prior Art

Originally one could put a special tape on the face of a golf club and hit the ball. After striking the ball the tape would have on it a mark showing where the club face contacted the ball. This is not practical because it can only be used at the golf course and it is not efficient because the tape can only be used once.

3. Objects and Advantages

Accordingly, several objects and advantages are . . .

(a) to provide a practice cover for golfers so that they can practice their driving accuracy at home or in between turns on the golf course.
(b) to provide a practice cover that can be used many times and is easy to clean.
(c) to provide a cover that fits most styles of club heads.
(d) to provide a practice cover that gives precise information to the user, such as the contact point between a simulated golf ball and the golf club face.
(e) to provide a practice cover that can be attached or removed fast and easily.
(f) to provide a practice cover that can be used anywhere one can swing a golf club.

Further objects and advantages of this invention will become apparent from a consideration of the drawings and ensuing description of drawings.

DRAWING FIGURES

In the drawings, closely related figures have the same number by different alphabetic suffixes.

Reference Numerals In Drawings

Figure 1A:
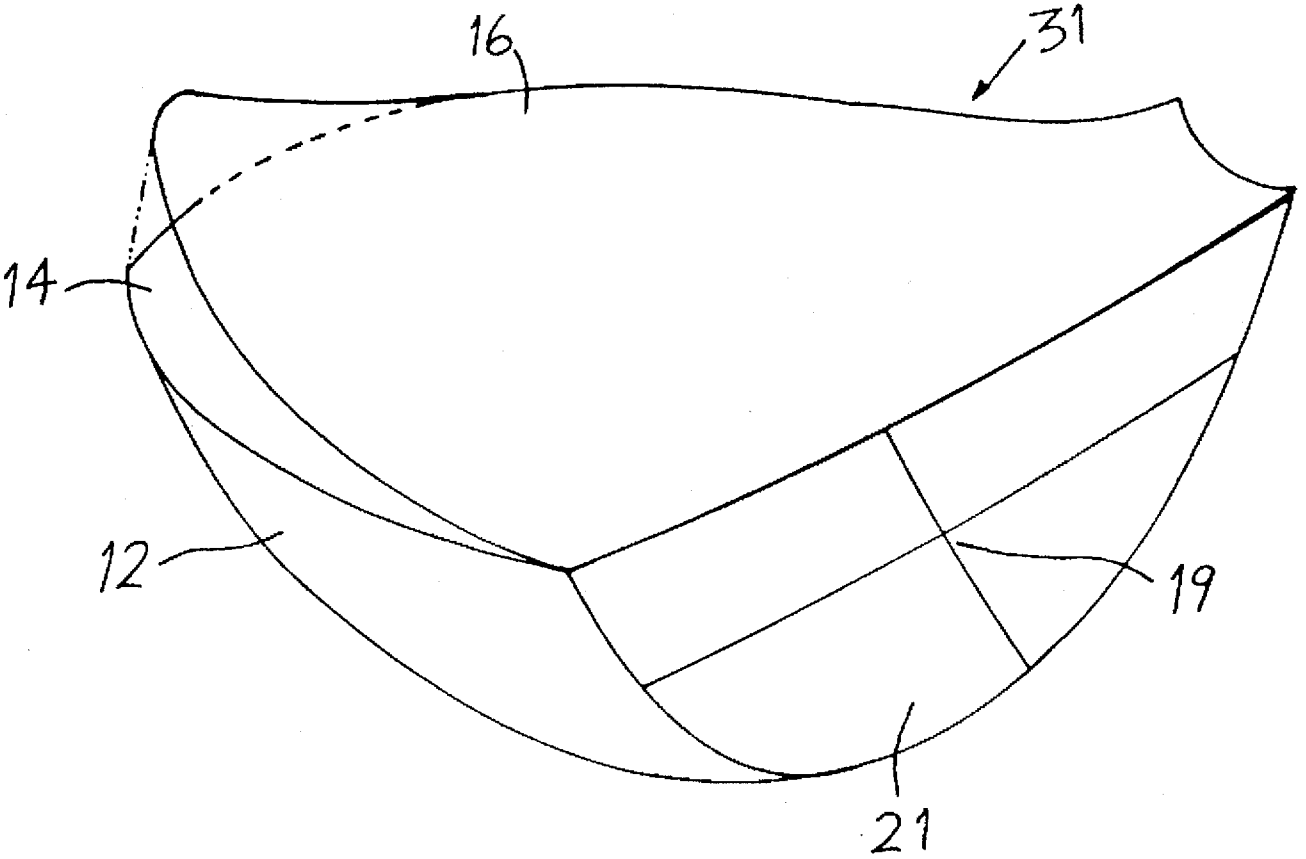
FIG. 1A is a top and side view of the practice cover.
Figure 1B:
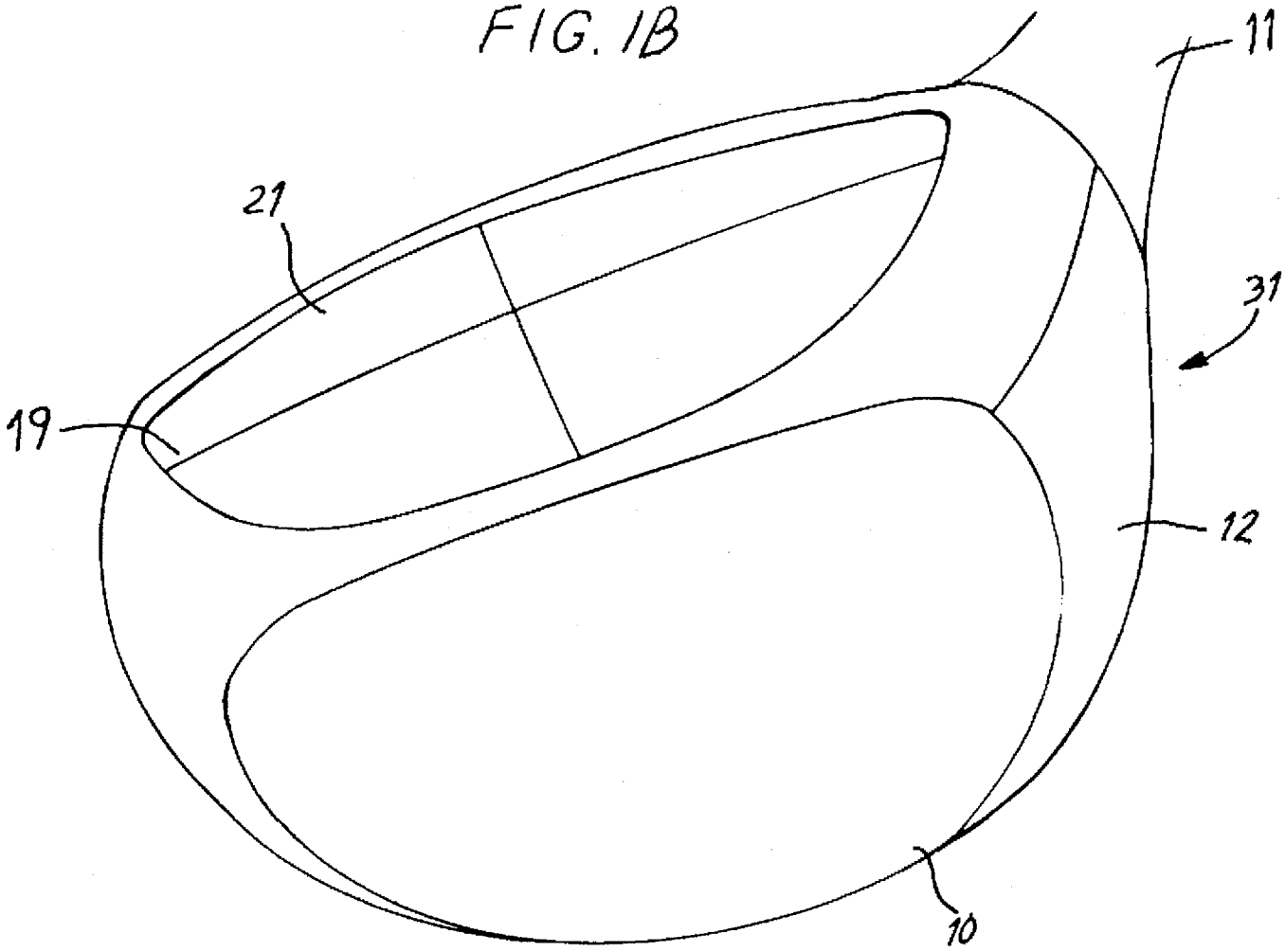
FIG. 1B is a bottom and side view of the practice cover.
Figure 1C:
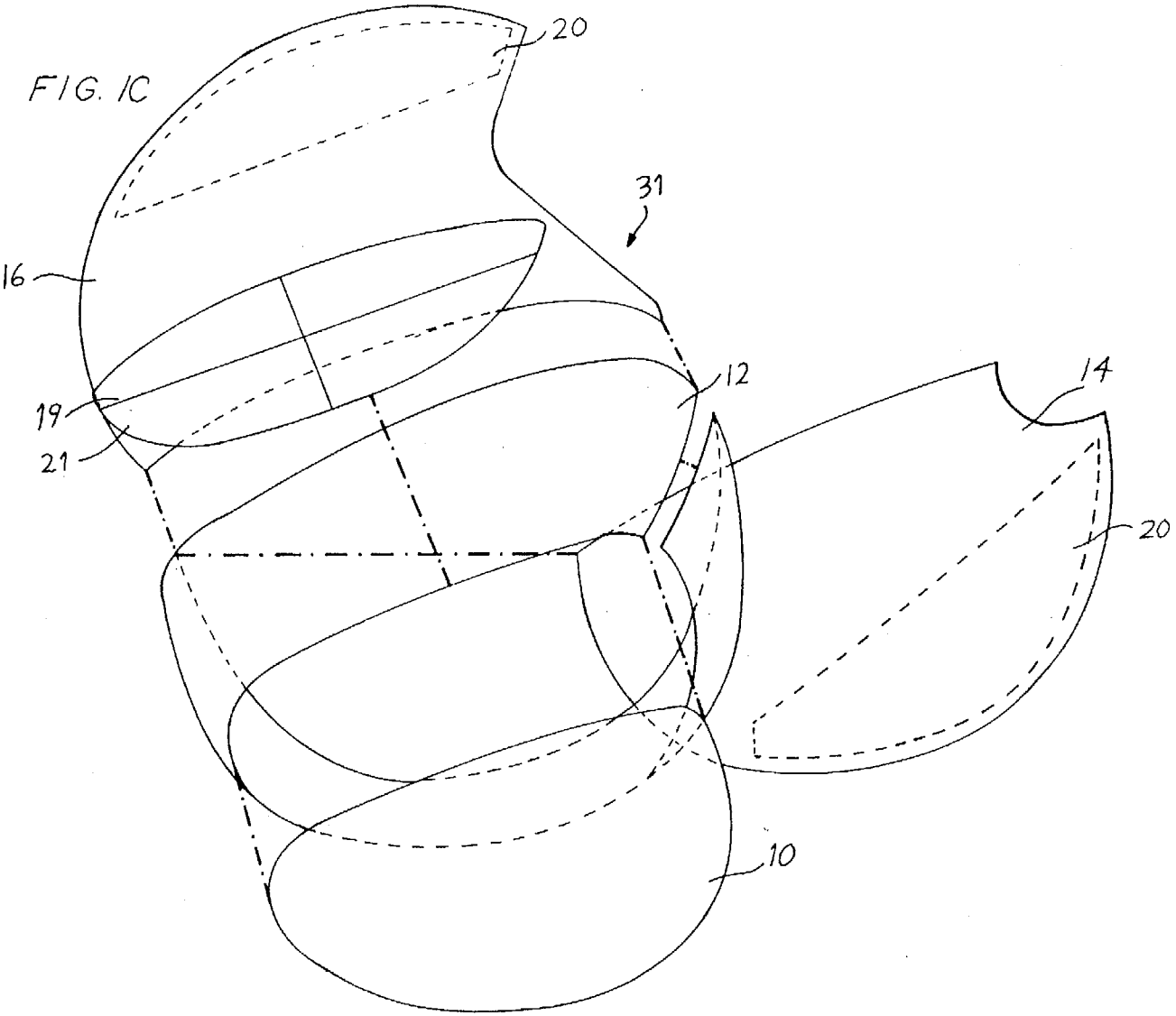
FIG. 1C is an enlarged view of the practice cover.

| | |
|---|---|
| 10. Base of cover | 11. Golf club driver |
| 12. Cover gusset | 13. Club head |
| 14. Lower flap | 15. Weight pocket |
| 16. Upper flap | 17. Golf club shaped cover |
| 18. Weighted pouch | 19. Embroidered cross hairs |
| 20. Fastener hook & loop | 21. Club face hook & loop |

-continued

| | |
|---|---|
| 22. Practice disk | 23. Club face |
| 24. Tee-head shaped void | 25. Practice diskhook & loop |
| 26. Center hole | 28. Light weight flex material |
| 29. Tube shaped tee | 30. Standard golf tee |
| 31. Practice cover | 32. Peel & stick practice cover |
| 33. Strap practice cover | 34. Multi-surface tee |
| 42. Eye for straps | 44. Upper fabric |
| 46. Lower fabric | 48. Hook & loop fastener straps |
| 50. Inner lining | |

DETAILED DESCRIPTION OF THE PREFERRED EMBODIMENT

Referring now to the drawings in detail, wherein like reference numerals designate like elements throughout the several views thereof, there is shown generally at 31 a practice cover embodying the present invention in a preferred form secured to a club head 13 of a golf club driver 11 of ordinary construction.

As shown in FIGS. 1A–3A, the practice cover of the present invention generally includes a golf club shaped cover 17 made of a pliable material that fits over club head 13 of driver 11 and is fastened tight by a fastener hook and loop 20.

Once practice cover 31 is properly positioned over club head 13, a club face hook and loop 21 will have on it an embroidered cross hairs 19 using thread that contrasts with club face hook and loop 21.

Figure 2A:
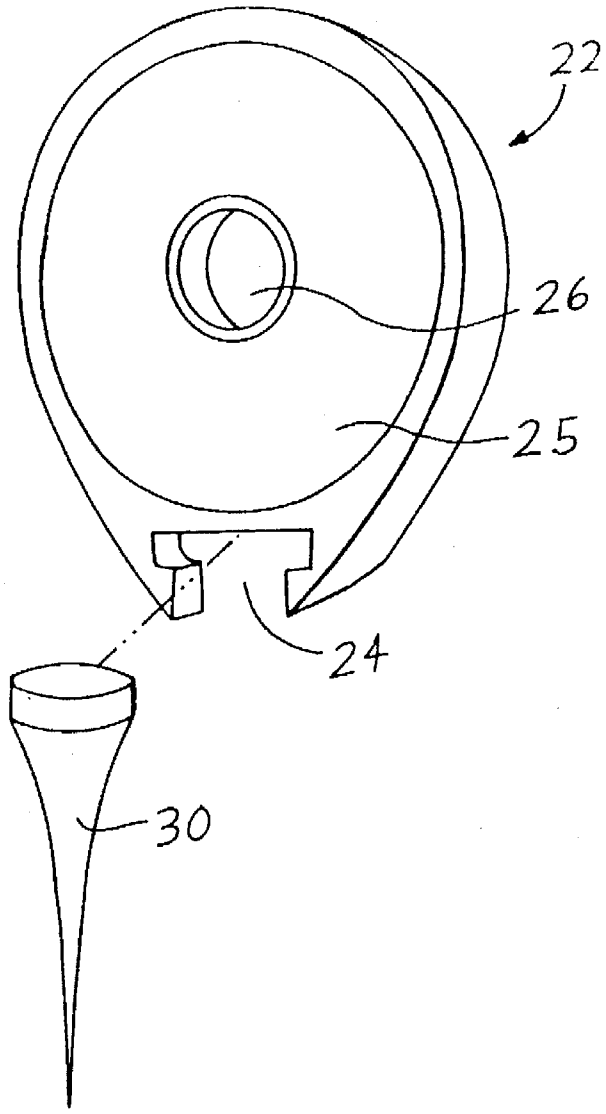
FIG. 2A is a perspective view of the practice disk.

FIG. 2A shows a perspective view of a basic version of the practice disk 22. A practice disk hook and loop 25 will be adhered to one or both sides of practice disk 22, which is made of a flexible material and is about the same diameter as a standard golf ball.

In addition practice disk 22 has a tee-head shaped void 24 along one section of its perimeter and a substantial center hole 26.

Figure 3A:
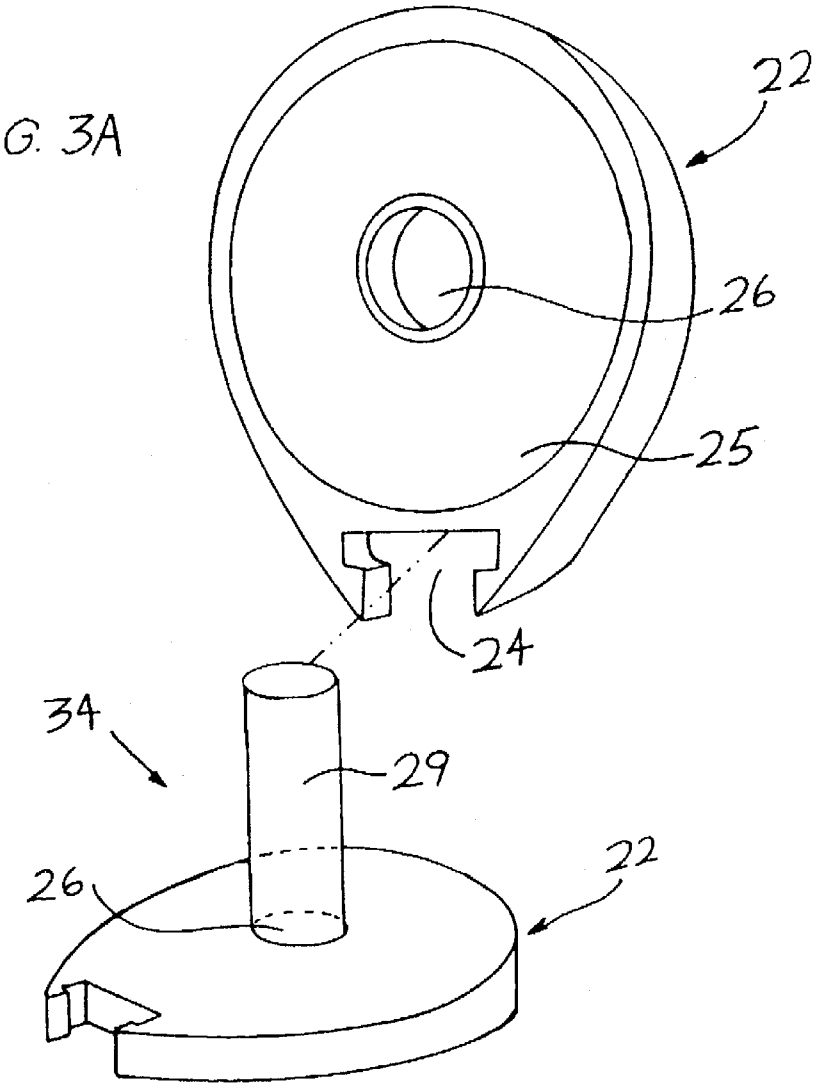
FIG. 3A is a perspective view of the multi-surface tee.

FIG. 3A shows a perspective view of a multi-surface tee 34 which is a tube shaped tee 29 that friction fits into center hole 26 of practice disk 22. The opposite end friction fits into void 24 of another practice disk 22.

Figure 4A:
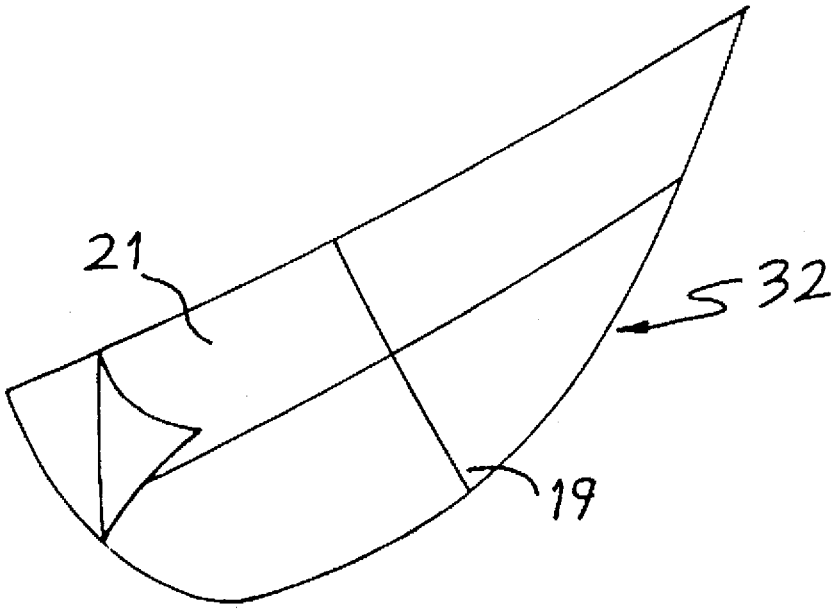
FIG. 4A is a perspective view of the peel and stick version of the invention.

FIG. 4A shows a perspective view of a peel and stick version of the invention. A piece of hook and loop fastener is cut into the shape of a golf club face 21, which has a peel and stick backing.

Figure 5A:
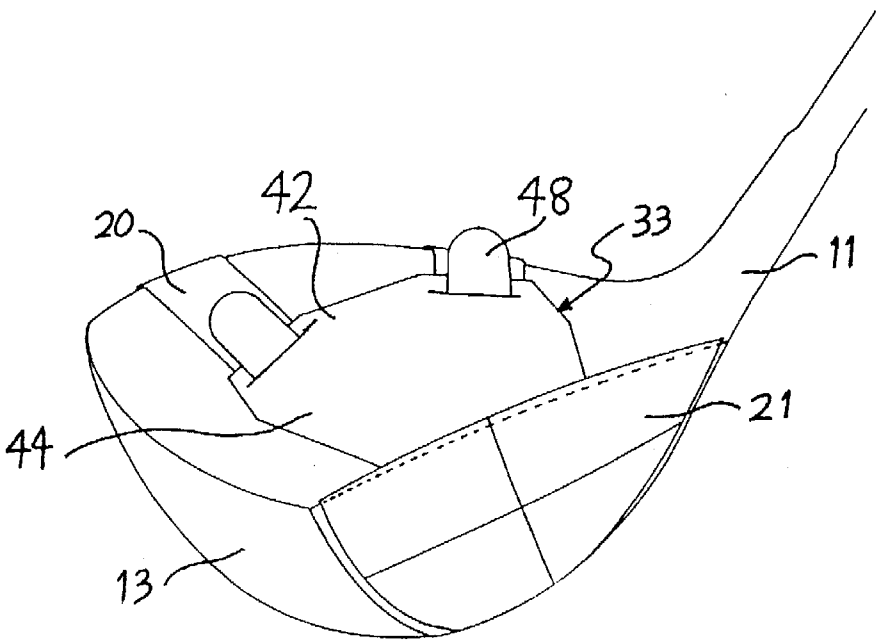
FIG. 5A is a perspective view of the strap version of the invention.
Figure 5B:
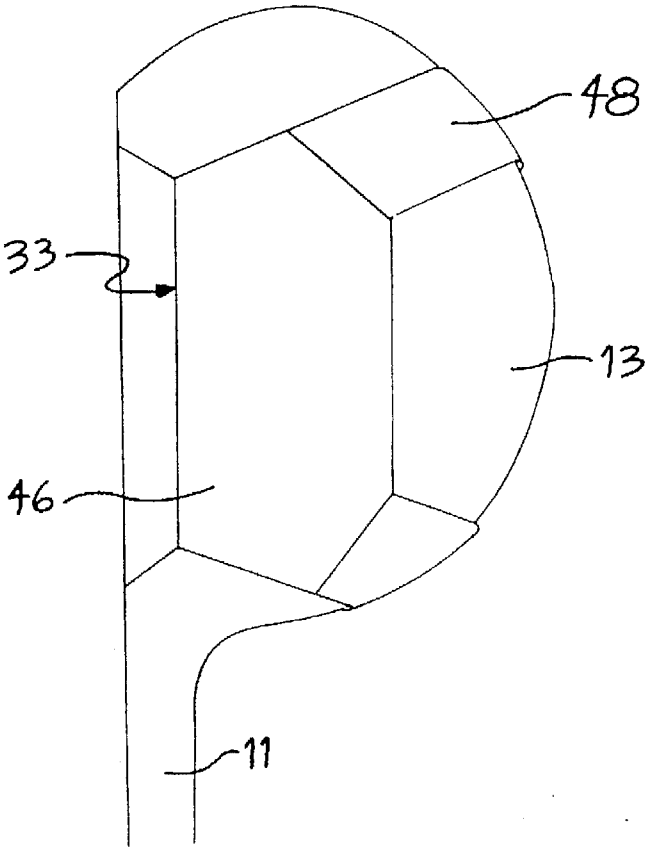
FIG. 5B is a bottom view of the strap version of the invention.

FIGS. 5A and 5B show perspective views of a basic strap version of the invention. The main parts are a club face hook and loop 21, which is connected to a lower fabric 46 and a upper fabric 44. An eye for straps 42 is also connected to club face hook and loop 21 or upper fabric 44. Hook and loop fastener 48 are attached to lower fabric 46.

Figure 6A:
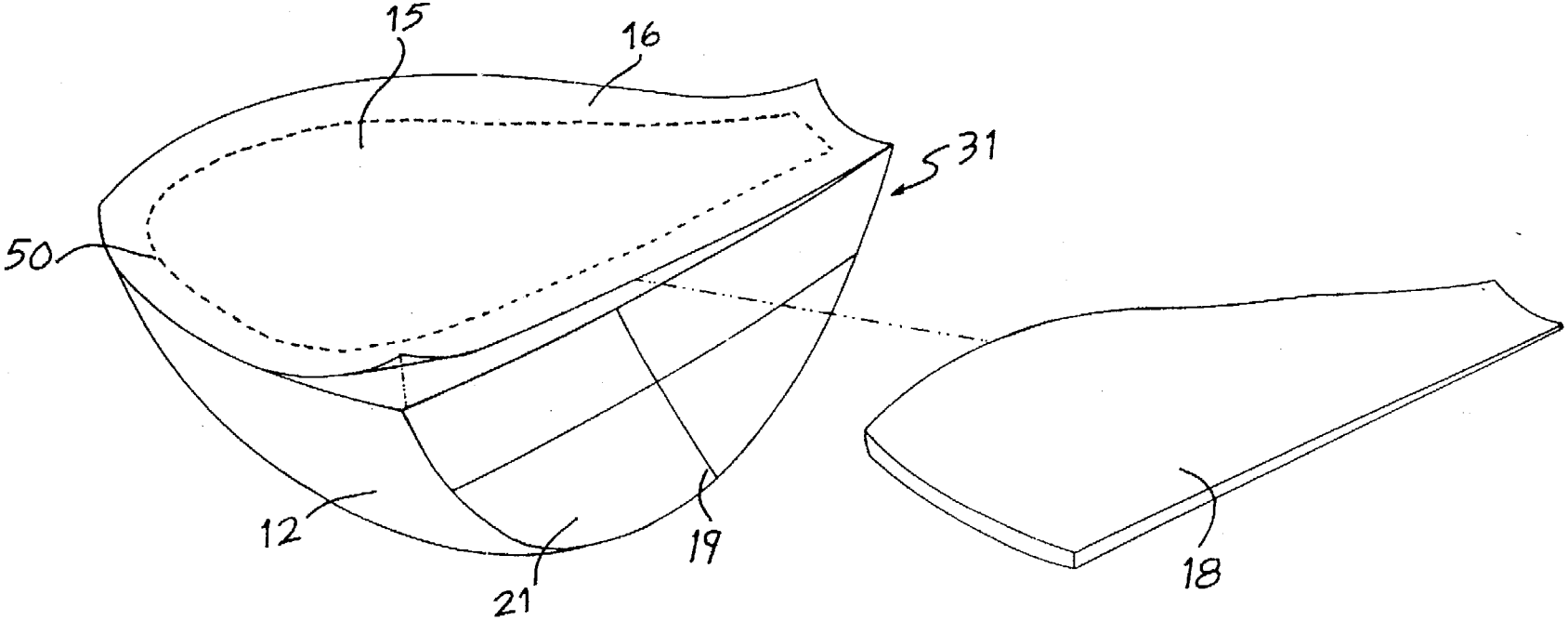
FIG. 6A is a perspective view of the weighted pouch and weight pocket.
Figure 7A:
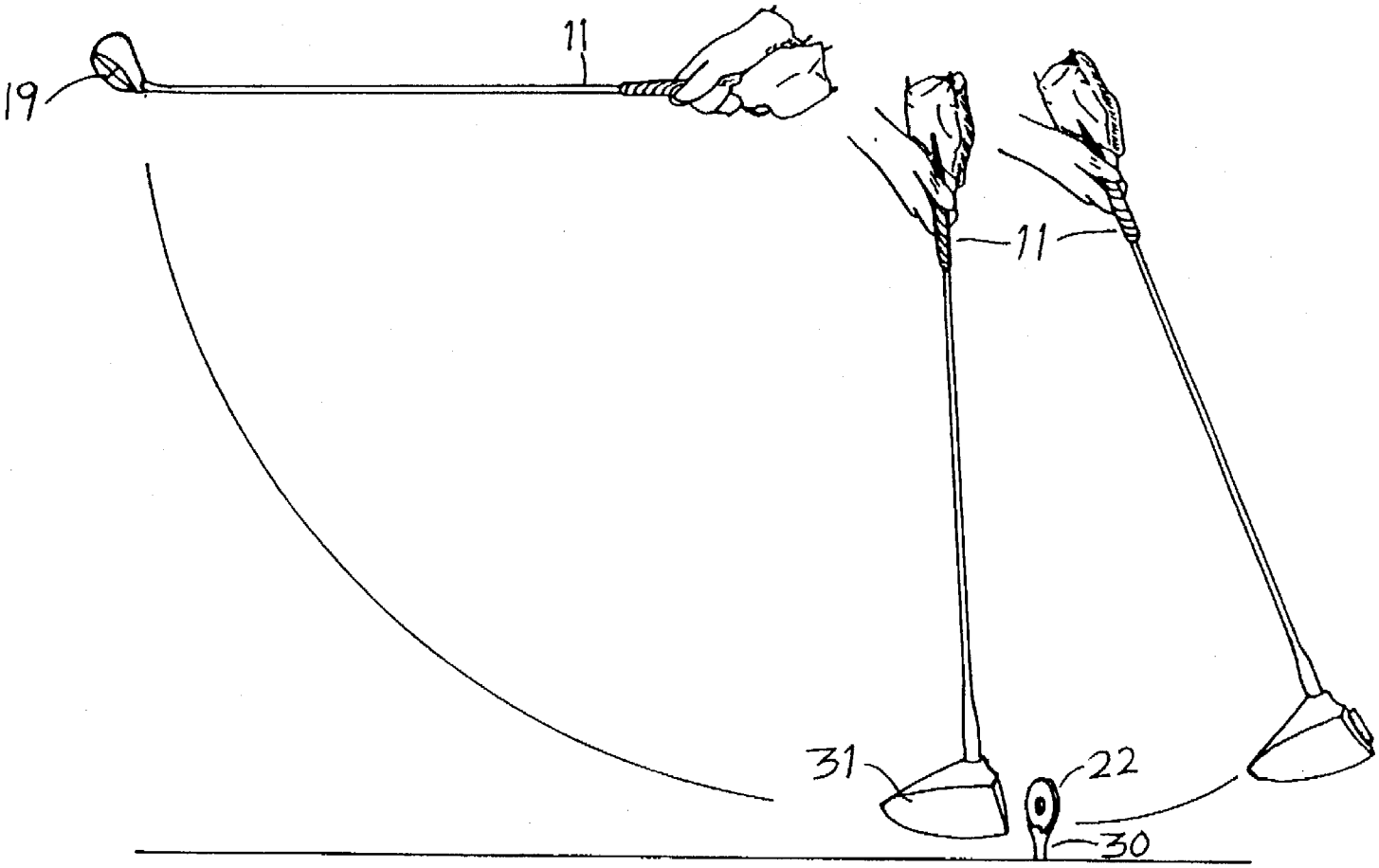
FIG. 7A is a perspective view of the practice cover in its preferred embodiment as it is being used.

FIG. 6A is a perspective view of a weighted pouch 18 and a weight pocket 15. A pocket is made in an inner lining 50 of upper flap 16. A substantial weight is sewn in between two pieces of fabric to form the weighted pouch, 18, which is placed into weight pocket 15.

Operation of Preferred Embodiment—FIGS. 1A–3A

Use of the golf club practice cover is as follows:

Place cover 31 over club head 13 of driver 11. Once in place, club face hook and loop 21 should rest directly over club face 23 of club head 13. Once this is accomplished, upper flap 16 is secured to lower flap 14 by using a fastener hook and loop 20. Now with the cover securely in place one must tee-up a practice disk 22 using a standard golf tee 30 or a multi-surface tee 34. Place tee-head shaped void 24 of practice disk 22 over the head of standard golf tee 30 or if using multi-surface tee 34 one can place a tube shape 29 into center hole 26 of practice disk 22 and then place tee-head shaped void 24 of another practice disk 22 over the opposite end of tube shape 29.

One can then swing the golf club driver (just as one would swing at a regular golf ball) and strike practice disk 22 with club face hook and loop 21. Practice disk 22 will stick to club face hook and loop 21 at the point of contact. Having completed his swing, a golfer can now look at his club and see exactly where he made contact with the practice disk and adjust his swing accordingly.

Operation of Peel and Stick Version FIG. 4A

In order to use the embodiment of my invention pictured in FIG. 4A one simply adheres the sticky back side of club face hook and loop 21 to the face of a golf club driver 11. One would then proceed in the same way as in the preferred embodiment.

Operation of Strap Version FIG. 5A

The strap version of the practice cover is placed around the head of a golf club driver. The hook and loop fastener straps 48 are then each separately inserted through the eyes for straps 42 and then tightened by cinching up and then pulling back. The straps 48 are then secured laying them flat on the hook and loop fastener on the back of the strap 48. One would then proceed as in the preferred embodiment.

SUMMARY RAMIFICATIONS AND SCOPE

Accordingly, the reader will see that the golf club cover can be used by a golfer to improve distance and accuracy at home and even on the course while waiting to tee up. The cover is easy and quick to attach and will fit most golf club drivers. In addition it can be thrown in the washing machine for easy cleaning so it can be used many times before wearing out. Furthermore, it can be used anywhere, anytime.

Thus the scope of the invention should be determined by the appended claims and their legal equivalents, rather than by the examples given.

I claim:

1. An article of sporting goods used by golfers to practice their driving, comprising:

a predetermined number of pieces of a pliable material, means for joining said pliable material together so that combined they will fit snugly around the contour of a golf club driver to form a practice cover, a piece of hook material cut into the size and shape of the face of said golf club driver, means for joining said piece of hook material to said pliable material so that said piece of hook material will rest over said face of said golf club driver when said cover is in place over said driver, a piece of light weight flexible material of substantial thickness with loops on one or both sides that will interlock with the hooks of said piece of hook material when they are joined, said piece of light weight flexible material being in the shape of a disk the width of a standard golf ball's diameter to form a practice disk, a predetermined length of tube shaped material the same width as the top of a standard golf tee, said practice disk has through it's center a hole the width of the top of said standard golf tee whereby one practicing with said practice cover can see the exact point of contact between said practice disk and said practice cover, and said practice disk has on one side along the perimeter a tee head shaped void the size and shape of the top of said standard golf tee top whereby said practice disk fits snugly over the contour of said standard golf tee top or one end of said length of tubing, whereby one could fit said tube shaped material into the center hole of said practice disk and the other end into said tee head shaped void to form a multi surface tee.

* * * * *